US010305226B2

(12) United States Patent
Iida et al.

(10) Patent No.: US 10,305,226 B2
(45) Date of Patent: May 28, 2019

(54) SHIELD CONNECTOR

(71) Applicants: Sumitomo Wiring Systems, Ltd., Yokkaichi-shi, Mie (JP); Toyota Jidosha Kabushiki Kaisha, Toyota-shi, Aichi (JP)

(72) Inventors: Tetsuya Iida, Yokkaichi (JP); Yosuke Kurono, Okazaki (JP); Tatsuhiko Mizutani, Toyota (JP)

(73) Assignees: Sumitomo Wiring Systems, Ltd. (JP); Toyota Jidosha Kabishiki Kaisha (JP)

( * ) Notice: Subject to any disclaimer, the term of this patent is extended or adjusted under 35 U.S.C. 154(b) by 0 days.

(21) Appl. No.: 15/769,084

(22) PCT Filed: Oct. 14, 2016

(86) PCT No.: PCT/JP2016/080474

§ 371 (c)(1),
(2) Date: Apr. 18, 2018

(87) PCT Pub. No.: WO2017/073354

PCT Pub. Date: May 4, 2017

(65) Prior Publication Data

US 2018/0309245 A1 Oct. 25, 2018

(30) Foreign Application Priority Data

Oct. 28, 2015 (JP) ..... 2015-211612

(51) Int. Cl.
*H01R 13/659* (2011.01)
*H01R 13/6591* (2011.01)
(Continued)

(52) U.S. Cl.
CPC ..... *H01R 13/6591* (2013.01); *H01R 13/6593* (2013.01); *H01R 13/6598* (2013.01)

(58) Field of Classification Search
CPC ..... H01R 13/6592; H01R 9/032
See application file for complete search history.

(56) References Cited

U.S. PATENT DOCUMENTS 6,837,728 B2 * 1/2005 Miyazaki ..... H01R 9/032 439/271
7,614,910 B2 * 11/2009 Croteau ..... H01R 13/512 439/559

(Continued)

FOREIGN PATENT DOCUMENTS

JP 2013-59238 3/2013
JP 2015-95357 5/2015

(Continued)

OTHER PUBLICATIONS

International Search Report and Written Opinion dated Dec. 20, 2016.

*Primary Examiner* — Ross N Gushi
(74) *Attorney, Agent, or Firm* — Gerald E. Hespos; Michael J. Porco; Matthew T. Hespos

(57) ABSTRACT

A shield connector (1) includes electric wires (11), a housing (20), a shield conductor (30), and a shield bracket (40). The shield bracket 40 includes a main bracket (50) including a conductor holding portion (51), first and second connection portions (61, 71) and an auxiliary bracket (80). The conductor holding portion (51) and the shield conductor (30) held thereby the cover outlet tubes (27) and the electric wires (11) from one side. The housing (20) includes first and second attachment protrusions (25, 26). The first connection portion (61) includes a first attachment piece (64) engaged with the first attachment protrusion (25). The auxiliary bracket (80) includes an auxiliary attachment piece (82) engaged with the second attachment protrusion (26). An overlapping plate (81) of the auxiliary bracket (80) is (Continued)

swaged onto the second connection portion (71) by a swaging piece (75) of the second connection portion (71).

9 Claims, 10 Drawing Sheets

(51) Int. Cl.
*H01R 13/6593* (2011.01)
*H01R 13/6598* (2011.01)

(56) References Cited

U.S. PATENT DOCUMENTS 8,395,047 B2 * 3/2013 Adachi ..... B60L 3/0007 174/74 R
8,939,795 B2 1/2015 Tsuchiya et al.
9,004,947 B2 * 4/2015 Tanaka ..... H01R 13/5213 439/607.41
9,033,734 B2 * 5/2015 Tanaka ..... H01R 9/032 439/587
9,083,107 B2 * 7/2015 Suzuki ..... H01R 13/5219
9,208,922 B2 * 12/2015 Yoshida ..... H01B 1/02
9,325,120 B2 * 4/2016 Imahori ..... H01R 13/6592
9,386,733 B2 * 7/2016 Adachi ..... B60R 16/0215
9,613,730 B2 * 4/2017 Tanaka ..... H05K 9/0098
9,674,994 B2 * 6/2017 Yoshida ..... H01R 13/6593
9,742,124 B2 * 8/2017 Kusamaki ..... H01R 9/034
10,062,974 B2 * 8/2018 Okamoto ..... H01R 4/30
2004/0057187 A1 * 3/2004 Kuboshima ..... H01R 9/032 361/118
2013/0065405 A1 3/2013 Tsuchiya et al.
2014/0030921 A1 * 1/2014 Kobayashi ..... H01R 13/6591 439/607.01
2014/0051282 A1 * 2/2014 Tanaka ..... H01R 13/6581 439/502
2014/0248800 A1 * 9/2014 Tanaka ..... H01R 12/777 439/607.01
2014/0287631 A1 * 9/2014 Tashiro ..... H01R 13/521 439/733.1
2014/0305696 A1 * 10/2014 Tanaka ..... H01R 12/594 174/71 R
2015/0126055 A1 * 5/2015 Morita ..... H01R 13/5202 439/323
2015/0129305 A1 * 5/2015 Yoshida ..... H01B 1/02 174/720
2016/0255750 A1 9/2016 Yoshida et al.
2016/0380390 A1 12/2016 Kusamaki et al.
2018/0294593 A1 * 10/2018 Iida ..... H01R 13/56
2018/0309245 A1 * 10/2018 Iida ..... H01R 13/6593

FOREIGN PATENT DOCUMENTS

JP 2015-153591 8/2015
JP 2016-131481 7/2016
WO 2015/072335 5/2015
WO 2016/111070 7/2016

* cited by examiner

SHIELD CONNECTOR

BACKGROUND

Field of the Invention

The technology disclosed herein relates to a shield connector.

Description of the Related Art

A known shield connector includes a pair of brackets (see Japanese Unexamined Patent Application Publication No. 2015-95357). The brackets each include a planer crimping piece onto which a sheet-shaped shield conductor is crimped. The brackets facing each other are fixed to the housing such that the shield conductors form a tubular shape. The electric wires protruding from the housing are positioned in the tube formed by the shield conductors.

Components mounted in vehicles have been demanded to be smaller and lighter and to be produced at a lower cost, for example. This leads a demand for shield connectors to have a simple structure and a readily attachable configuration.

SUMMARY

A shield connector disclosed herein includes a connector housing, an electric wire extending outward from the connector housing, a shield conductor shielding the electric wire, and a shield attachment member holding the shield conductor and attached to the connector housing. The shield attachment member includes a main attachment member and an auxiliary attachment member attached to the main attachment member. The main attachment member includes a conductor holding portion positioned on one side of the connector housing and a first connection portion and a second connection each extending from the conductor holding portion. The shield conductor held by the conductor holding portion covers the electric wire from the one side. The connector housing includes a first engagement portion and a second engagement portion. The first connection portion includes a first receiving portion in engagement with the first engagement portion. The auxiliary attachment member includes a second receiving portion in engagement with the second engagement portion. The second connection portion includes a third engagement portion. The auxiliary attachment member includes a third receiving portion in engagement with the third engagement portion.

The electric wire extending from the shield connector may be bent at a right angle or a sharp angle. In such a case, the shield conductor does not need to be positioned at an inner side of the bent electric wire. The electric wire is sufficiently shielded by the shield conductor positioned at an outer side. In this case, employment of the shield connector having the above-described configuration provides a simple structure compared with a conventional configuration, because one of the two brackets and one of the two shield conductors are eliminated.

The shield attachment member includes the auxiliary attachment member. Thus, the second connection portion is able to be connected to the housing by using the auxiliary attachment member after the first connection portion is attached to the housing. This makes the attachment operation easy.

The first engagement portion and the second engagement portion may be positioned on an opposite side of the connector housing from a side facing the conductor holding portion. In this configuration, the connector housing includes the first engagement portion and the second engagement portion on the opposite side from the side facing the conductor holding portion, and the first and second connection portions are respectively connected to the first and second engagement portions. Thus, the first connection portion and the second connection portion are positioned on the opposite side of the connector housing from the conductor holding portion. This enables the shield attachment member to be stably attached to the connector housing. In this configuration, the second connection portion and the connector housing may be directly connected to each other without the auxiliary attachment member. However, such a configuration makes the attachment operation difficult, because, in the attachment operation, the conductor holding portion should be positioned along the connector housing from one side while, on the other side, the first and second connection portions are attached to the respective first and second engagement portions. In such a configuration, employment of the auxiliary attachment member is particularly effective in making the attachment operation easy. The auxiliary attachment member allows the second connection portion to be attached to the housing after the first connection portion is attached to the housing.

The auxiliary attachment member may include only the second receiving portion and the third receiving portion. This configuration allows the auxiliary attachment member to have a minimum size, making the structure of the shield connector simple.

One of the connector housing and the conductor holding portion may include a fourth engagement portion and the other may include a fourth receiving portion in engagement with the fourth engagement portion. In this configuration, the attachment is performed at three positions, i.e., the first engagement portion and the first connection portion are connected to each other, the second engagement portion, the auxiliary attachment member, and the second connection portion are connected to each other, and the fourth engagement portion and the fourth receiving portion are connected to each other, and thus the shield attachment member is stably attached to the connector housing. However, since the shield attachment member is connected to the connector housing at three engagement positions, the attachment operation may be more complex. In such a configuration, the attachment operation is more effectively made easier by employing the auxiliary attachment portion, which allows the connection at one of the three positions to be separately performed from the connection at the other two positions.

The technology disclosed herein allows a shield connector to have a simple structure and to have a readily attachable configuration.

DETAILED DESCRIPTION

Figure 1:
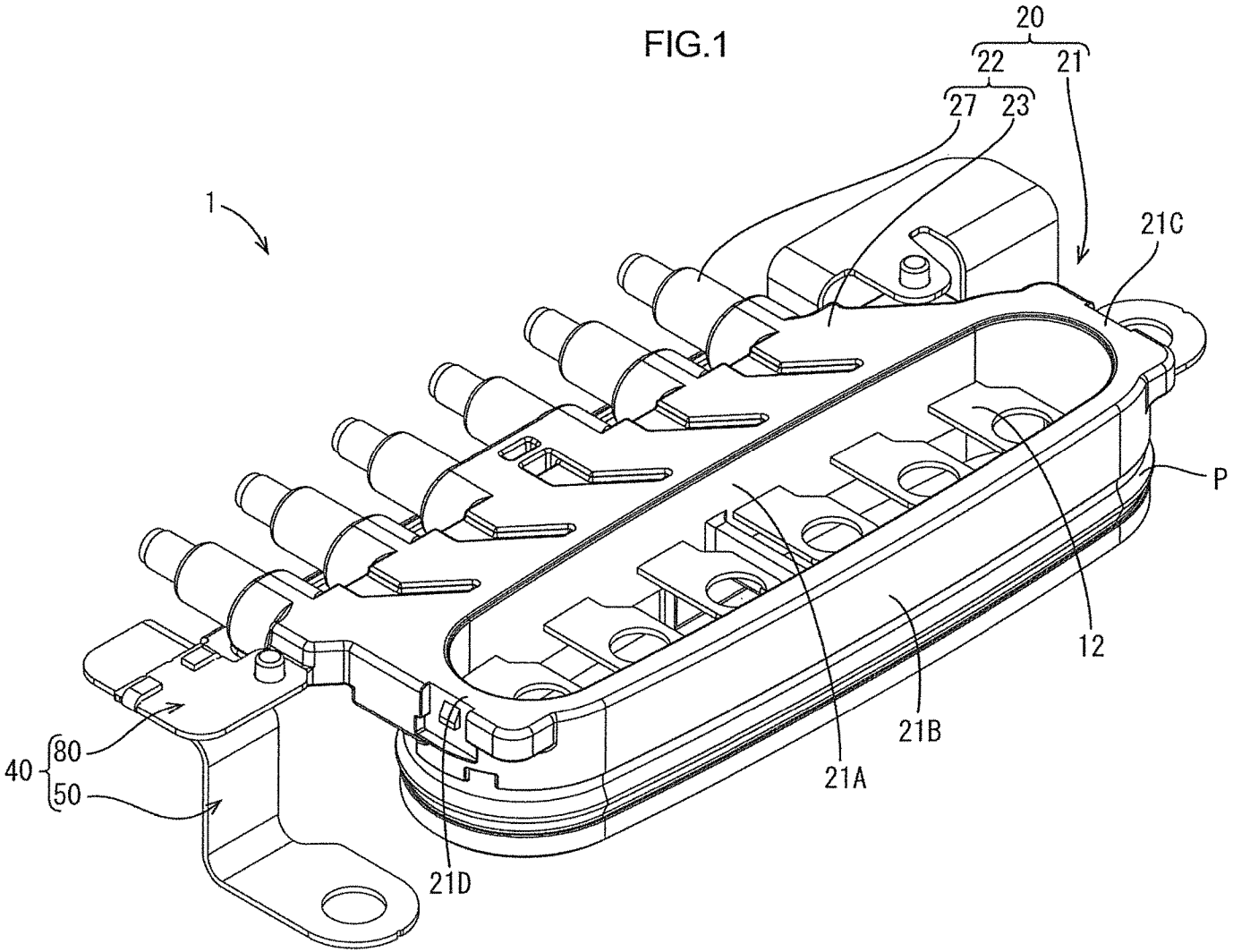
FIG. 1 is a perspective view of a shield connector according to an embodiment.

An embodiment is described with reference to FIG. 1 to FIG. 12. A shield connector 1 according the embodiment is configured to be mounted in an engine room of a vehicle and attached to a device case (not illustrated) that houses an inverter. The shield connector 1 includes six electric wires with terminals 10, a connector housing 20 holding the electric wires with terminals 10, a shield bracket 40 (corresponding to a shield attachment member) attached to the connector housing 20, and a shield conductor 30 attached to the shield bracket 40 to shield the electric wires 11.

Electric Wire with Terminal 10

The six electric wires with terminals 10 each have a common structure including an electric wire 11 and a terminal fitting 12 connected to an end of the electric wire 11.

Connector Housing 20

The connector housing 20 (hereinafter, referred to as a "housing 20" in some cases) is formed of a synthetic resin. As illustrated in FIG. 1, the connector housing 20 includes a hood 21 in which the terminal fittings 12 are positioned and an electric wire outlet 22 extending from the hood 21.

As illustrated in FIG. 1, the hood 21 has an overall rectangular tubular shape and includes two long walls 21A and 21B arranged substantially parallel to each other and two short walls 21C and 21D each connecting edges of the long walls 21A and 21B. The two long walls 21A and 21B are long in a direction perpendicular to the axial direction of the hood 21. A sealing packing P, which functions as a water stop between the device case and the housing 20, is attached to an outer surface of the hood 21.

As illustrated in FIG. 1, the electric wire outlet 22 includes an outlet body 23 extending from the hood 21 and six outlet tubes 27 extending from the outlet body 23. The outlet body 23 is a thick planar portion positioned perpendicular to the axial direction of the hood 21 and extends outward from the long wall 21A, which is one of the two long walls 21A and 21B of the hood 21.

Figure 3:
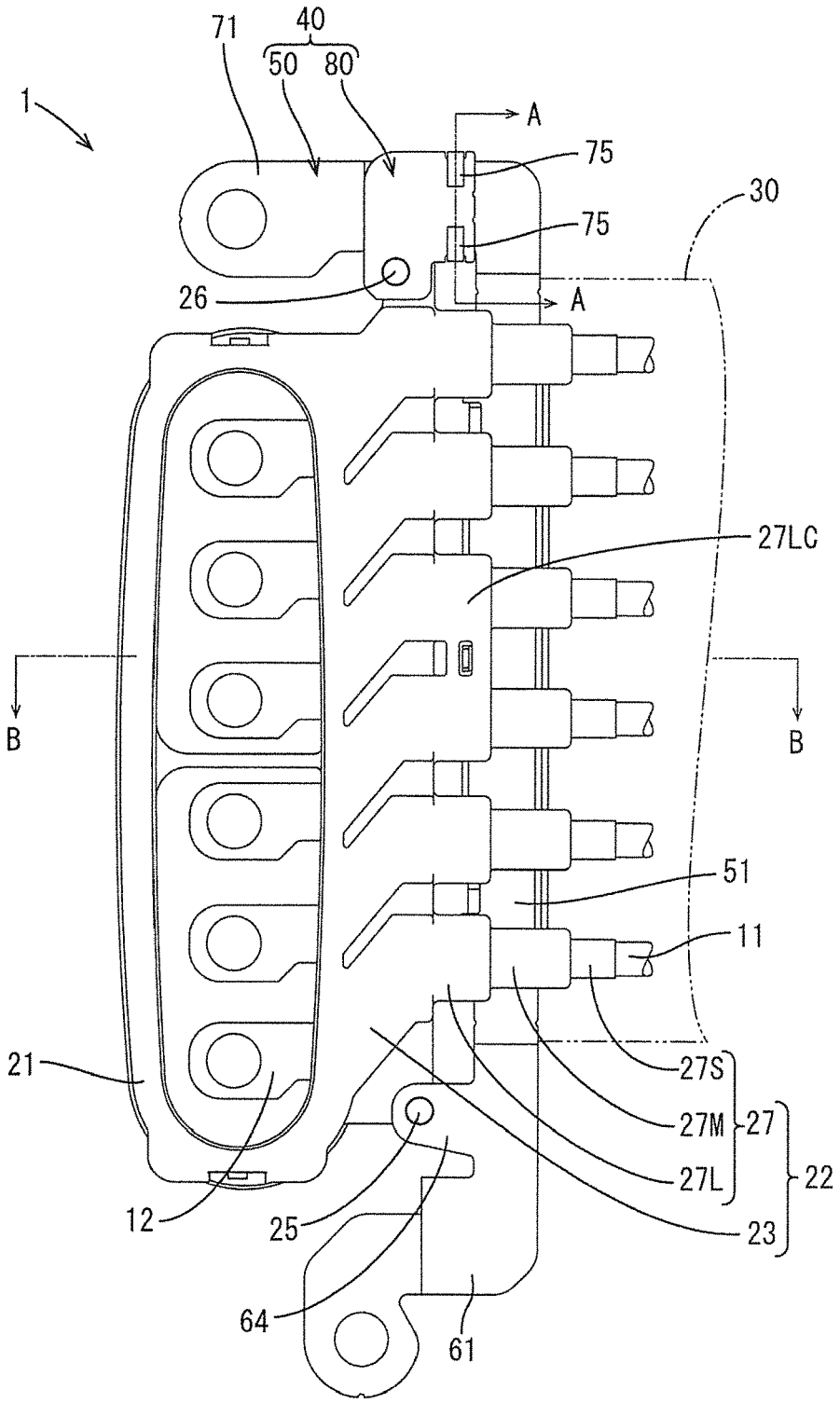
FIG. 3 is a plan view of the shield connector according to the embodiment.

As illustrated in FIG. 3, the six outlet tubes 27 extend from an end surface of the outlet body 23 parallel to the long wall 21A and are arranged next to each other in a direction perpendicular to the axial direction of the hood 21. The six outlet tubes 27 each have an overall circular tubular shape and include a large diameter portion 27L having a largest outer diameter, a small diameter portion 27S having a smallest outer diameter, and a middle diameter portion 27M having an outer diameter smaller than that of the large diameter portion 27L and larger than that of the small diameter portion. The large diameter portion 27L, the middle diameter portion 27M, and the small diameter portion 27S are coaxially arranged in this order from the outlet body 23. The large diameter portions 27L of two of the outlet tubes 27 that are located at the middle are connected to each other and form a coupled large diameter portion 27LC.

Ends of the electric wires 11 of the electric wires with terminals 10 are positioned in and held by the six outlet tubes 27 and the outlet body 23. One end of each terminal fitting 12 connected to the electric wire 11 is in the outlet body 23, and the other end thereof protrudes through the long wall 21A to the inside of the food 21. The other portion of each of the electric wires 11 extends outward through the outlet tube 27.

Figure 4:
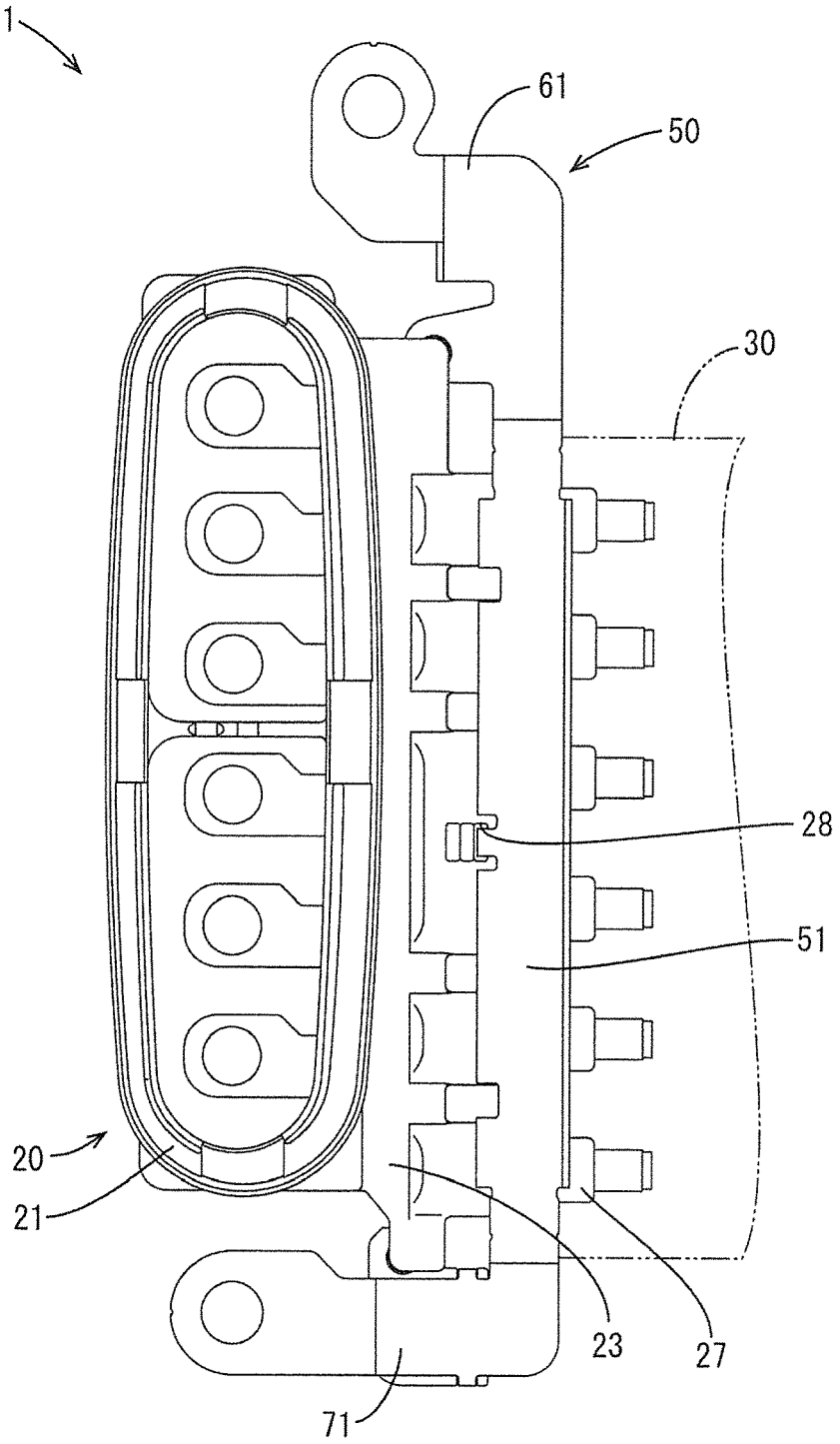
FIG. 4 is a bottom view of the shield connector according to the embodiment.
Figure 5:
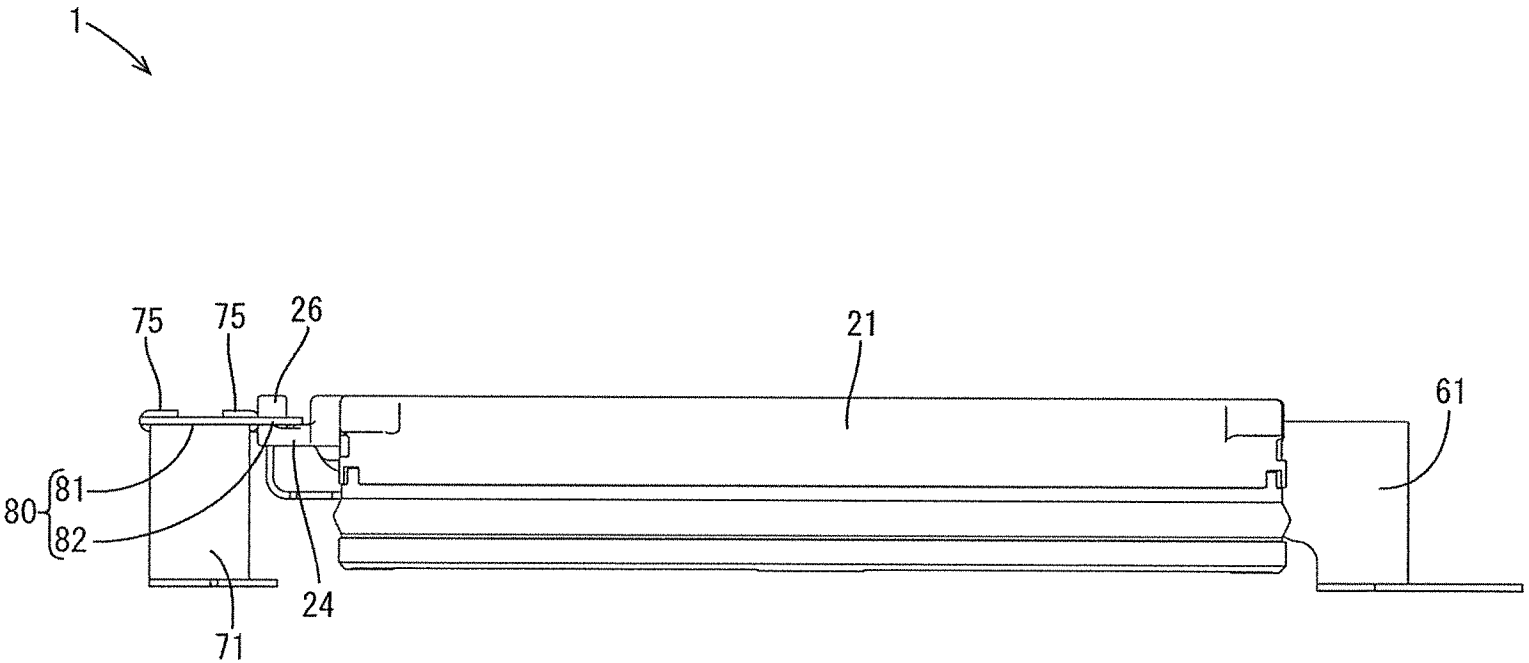
FIG. 5 is a front view of the shield connector according to the embodiment.
Figure 6:
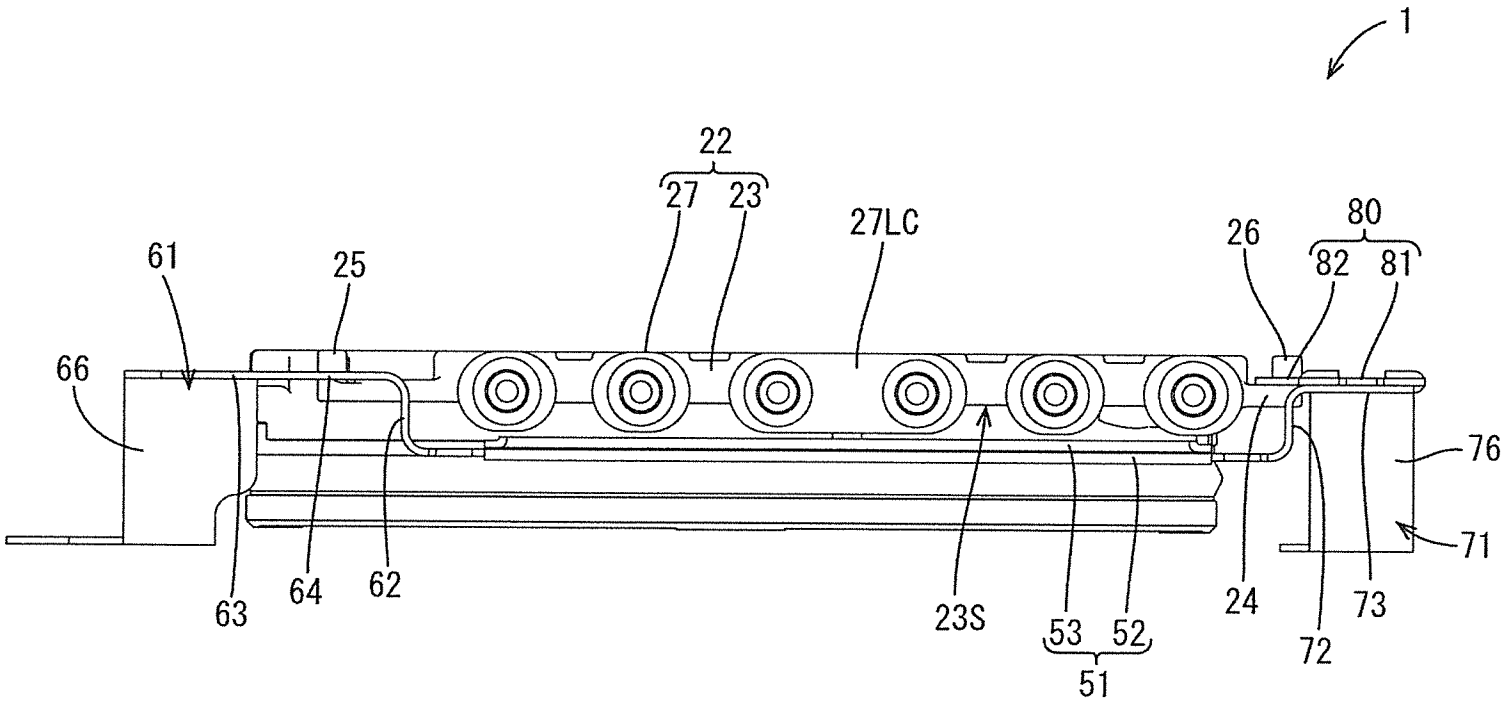
FIG. 6 is a rear view of the shield connector according to the embodiment.
Figure 7:
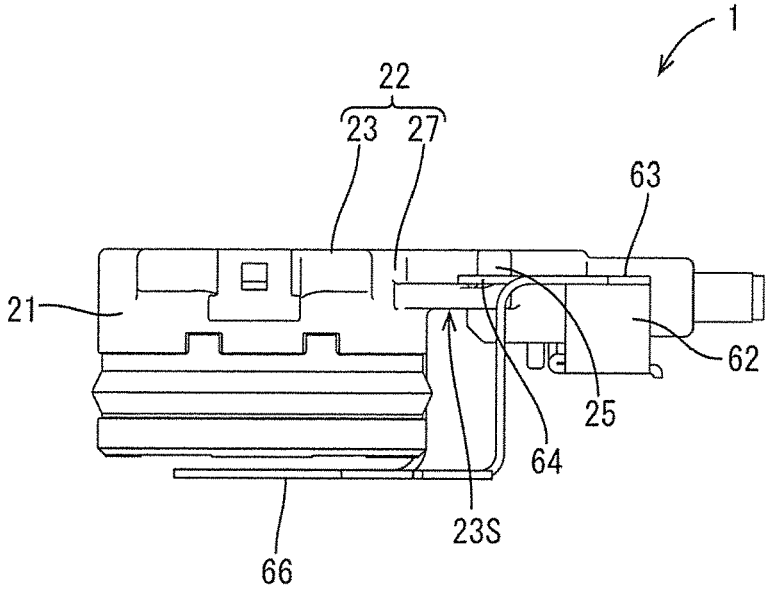
FIG. 7 is a right side view of the shield connector according to the embodiment.
Figure 10:
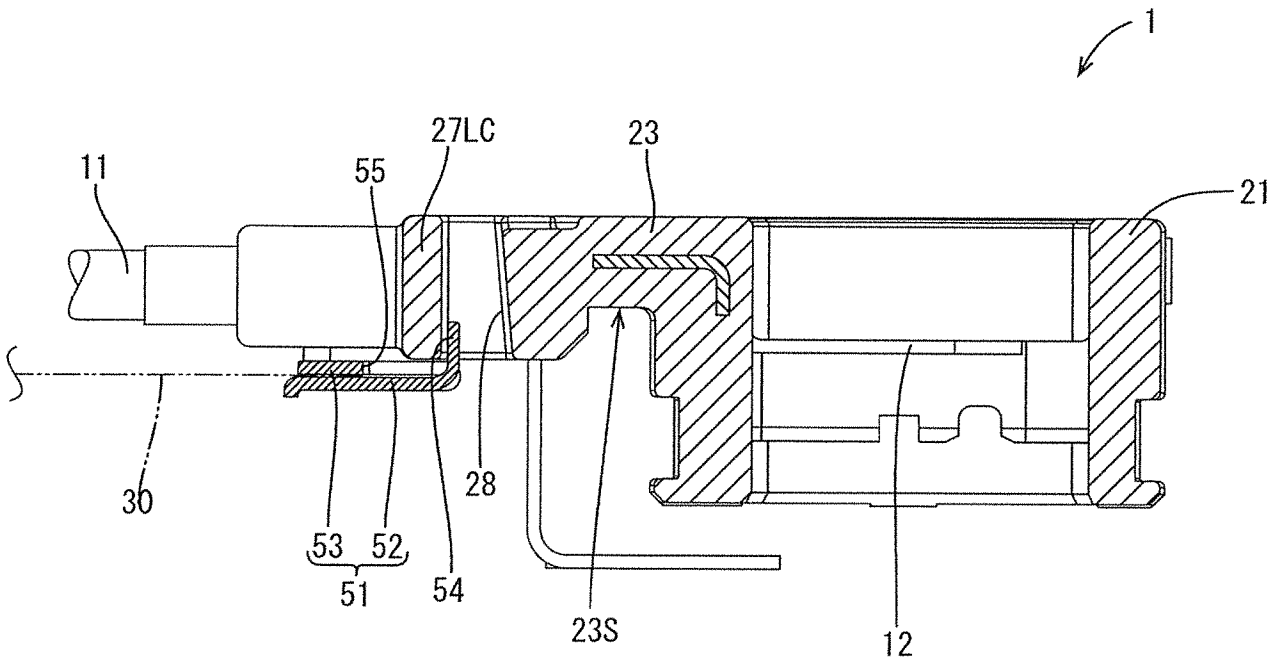
FIG. 10 is a cross-sectional view taken along line B-B in FIG. 3.

As illustrated in FIG. 6, FIG. 7, and FIG. 10, the outlet body 23 has two surfaces perpendicular to the long wall 21A and perpendicular to the axial direction of the hood 21. One of the surfaces is a shield surface 23S. As illustrated in FIG. 4 and FIG. 10, the electric wire outlet 22 has a retaining hole 28 (corresponding to a fourth receiving portion) at the coupled large diameter portion 27LC. The retaining hole 28 opens toward the same side as the shield surface 23S faces.

Figure 2:
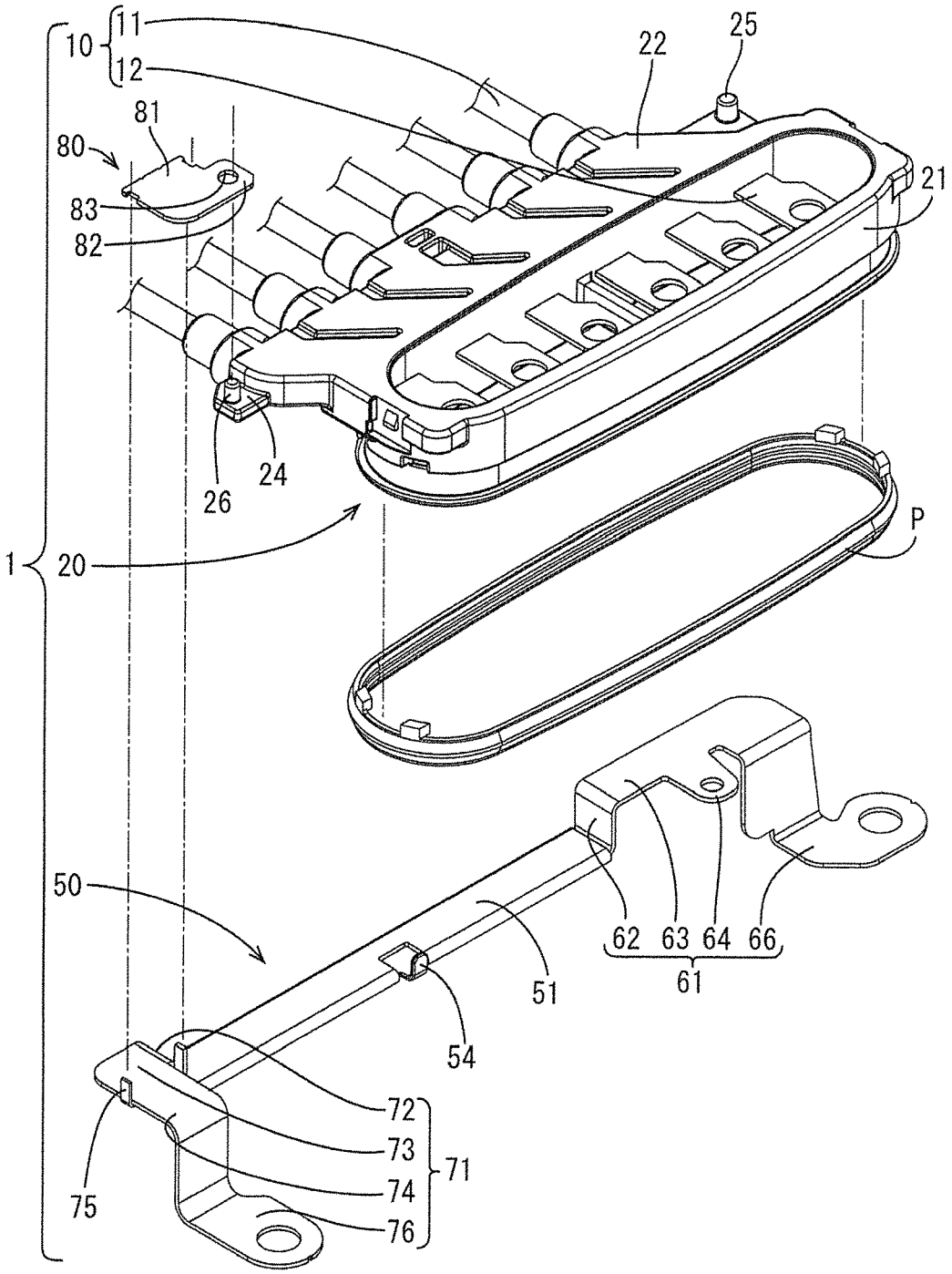
FIG. 2 is an exploded perspective view of the shield connector according to the embodiment.

As illustrated in FIG. 2, the electric wire outlet 22 includes an attachment portion 24 and two attachment protrusions 25 and 26. The attachment portion 24 is a planar portion protruding outwardly from one of edges (edges adjacent to the short walls 21C and 21D) of the outlet body 23. As illustrated in FIG. 2 and FIG. 6, one of the two attachment protrusions 25 and 26 (a second attachment protrusion 26, which corresponds to a second engagement portion) is a cylindrical portion protruding from the attachment portion 24 toward the side away from the shield surface 23S. As illustrated in FIG. 2 and FIG. 6, the other attachment protrusion (a first attachment protrusion 25, which corresponds to a first engagement portion) is positioned on an opposite end of the outlet body 23 from the attachment portion 24 and is a cylindrical portion protruding toward the side away from the shield surface 23S.

Although not illustrated in detail, the other ends of the six electric wires 11 are retained by another connector. The connector is attached to another device case that houses a motor.

Shield Conductor 30

The shield conductor 30 is a conductive metal cloth having flexibility and is a substantially rectangular sheet-shaped cloth formed of metallic threads. As illustrated in FIG. 3 and FIG. 10, the shield conductor 30 has a size enough to collectively cover the outlet tubes 27 and the electric wires 11 extending from the outlet tubes 27 from one side (from a side of the shield surface 23S, which is a lower side in FIG. 10).

Shield Bracket 40

As illustrated in FIG. 1, the shield bracket 40 is configured to fix the shield conductor 30 to the housing 20 and includes a main bracket 50 (corresponding to a main attachment member) and an auxiliary bracket 80 (corresponding to an auxiliary attachment member) attached to the main bracket 50.

Figure 11:
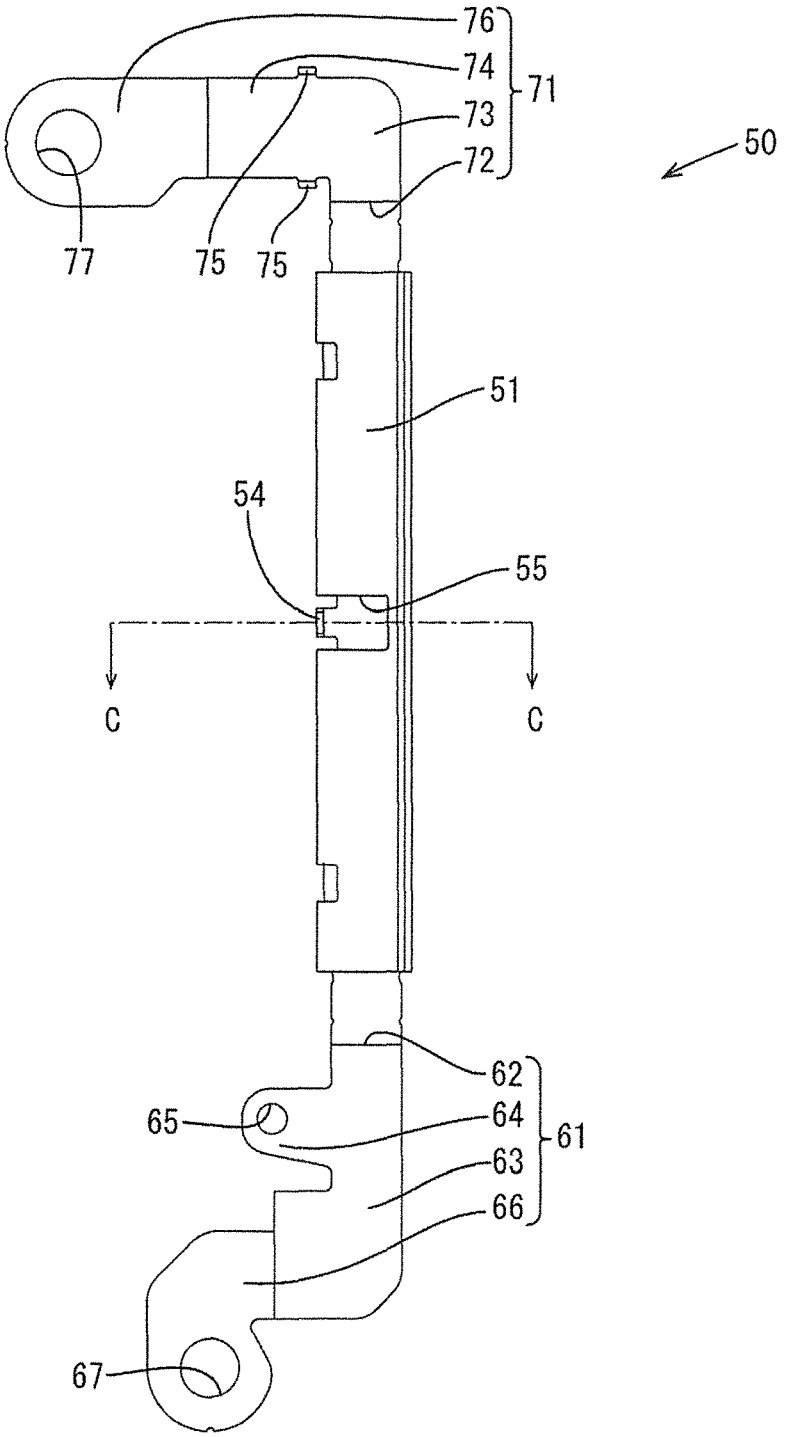
FIG. 11 is a plan view of a main bracket according to the embodiment.

The main bracket 50 is produced by pressing a metal plate having high conductivity, for example. As illustrated in FIG. 11, the main bracket 50 includes a conductor holding portion 51, a first connection portion 61 extending from the conductor holding portion 51, and a second connection portion 71 extending from the conductor holding portion 51.

The conductor holding portion 51 is configured to retain the shield conductor 30. The conductor holding portion 51 is a long flat plate elongated in one direction and folded in two at the middle between opposing long sides to sandwich and retain one end of the shield conductor 30.

Figure 12:
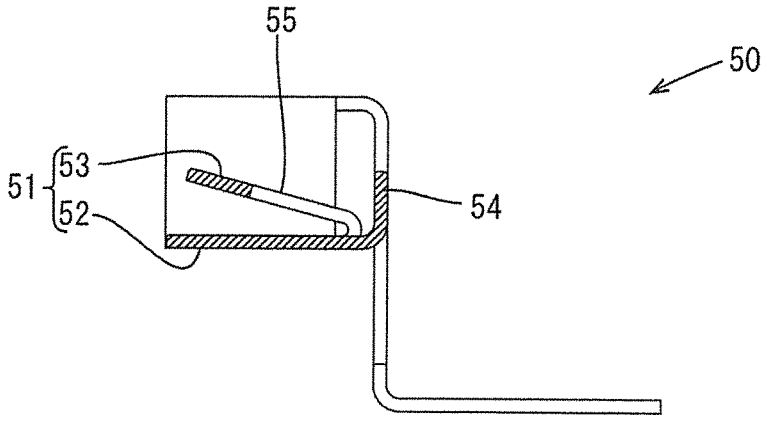
FIG. 12 is a cross-sectional view taken along line C-C in FIG. 11.

Specifically, as illustrated in FIG. 10 and FIG. 12, the conductor holding portion 51 includes a first sandwiching portion 52, a second sandwiching portion 53 extending from the first sandwiching portion 52, and a retaining piece 54 (corresponding to a fourth engagement portion). The first sandwiching portion 52 is an elongated belt-shaped portion. The second sandwiching portion 53 extends from one of two side edges of the first sandwiching portion 52 and is an elongated belt-shaped portion facing the first sandwiching portion 52. FIG. 12 illustrates the conductor holding portion 51 not retaining the shield conductor 30 (the second sandwiching portion 53 faces the first sandwiching portion 52 at an angle with a space therebetween). As illustrated in FIG. 10, the shield conductor 30 is retained by the conductor holding portion 51 when sandwiched between the first sandwiching portion 52 and the second sandwiching portion 53 at one end.

As illustrated in FIG. 11, the second sandwiching portion 53 has a cutout 55 extending inwardly from the side edge adjacent to the first sandwiching portion 52 at a middle between the ends. The retaining piece 54 is a small planar piece extending from the first sandwiching portion 52. As illustrated in FIG. 12, the retaining piece 54 extends from the first sandwiching portion 52 in a direction perpendicular to the first sandwiching portion 52 through the cutout 55.

As illustrated in FIG. 3 and FIG. 10, when the shield bracket 40 is fixed to the housing 20, the conductor holding portion 51 is positioned along a line of the six outlet tubes 27, and the conductor holding portion 51 and the shield conductor 30 retained by the conductor holding portion 51 cover the outlet tubes 27 and the electric wires 11 from one side (a side of the shield surface 23S, which is the lower side in FIG. 10).

As illustrated in FIG. 2, FIG. 6, and FIG. 11, the first connection portion 61 extends from one of the two ends of the conductor holding portion 51 and is configured to be fixed to the device case and the housing 20. The first connection portion 61 includes a first vertical plate portion 62, a first horizontal plate portion 63, a first attachment piece 64 (corresponding to a first receiving portion), and a first case fixture 66.

As illustrated in FIG. 2 and FIG. 6, the first vertical plate portion 62 is a planar portion extending from one of the two ends of the first sandwiching portion 52 in a direction perpendicular to the first sandwiching portion 52. As illustrated in FIG. 2 and FIG. 6, the first horizontal plate portion 63 is a planar portion extending from the first vertical plate portion 62 toward a side away from the first sandwiching portion 52. The first horizontal plate portion 63 is positioned in parallel to the first sandwiching portion 52.

As illustrated in FIG. 2 and FIG. 11, the first attachment piece 64 is a planar piece extending from the first horizontal plate portion 63 in a direction perpendicular to the extending direction of the first horizontal plate portion 63 (toward the outlet body 23 when the shield bracket 40 is fixed to the housing 20, see FIG. 3). The first attachment piece 64 has a first protrusion insertion hole 65 through which the first attachment protrusion 25 is inserted. The first protrusion insertion hole 65 is a through hole extending from one surface to the other surface of the first attachment piece 64.

As illustrated in FIG. 2, the first case fixture 66 is a planar portion extending from the first horizontal plate portion 63 in a direction perpendicular to the first horizontal plate portion 63 and then extending from the extension end in a direction away from the first horizontal plate portion 63 and the first sandwiching portion 52. The first case fixture 66 has a bolt insertion hole 67 through which a bolt for fixing the main bracket 50 to the device case is inserted.

As illustrated in FIG. 2, FIG. 6, and FIG. 11, the second connection portion 71 extends from the opposite end of the conductor holding portion 51 from the first connection portion 61 and is configured to be fixed to the device case and the housing 20. The second connection portion 71 includes a second vertical plate portion 72, a second horizontal plate portion 73, a swaging portion 74, two swaging pieces 75 (corresponding to a third engagement portion), and a second case fixture 76.

As illustrated in FIG. 6, the second vertical plate portion 72 is a planar portion extending in a direction perpendicular to the first sandwiching portion 52 from an opposite edge of the first sandwiching portion 52 from the first connection portion 61. The second vertical plate portion 72 faces the first vertical plate portion 62. As illustrated in FIG. 6, the second horizontal plate portion 73 is a planar portion extending from the second vertical plate portion 72 in a direction away from the first sandwiching portion 52 and is positioned parallel to the first sandwiching portion 52.

Figure 8:
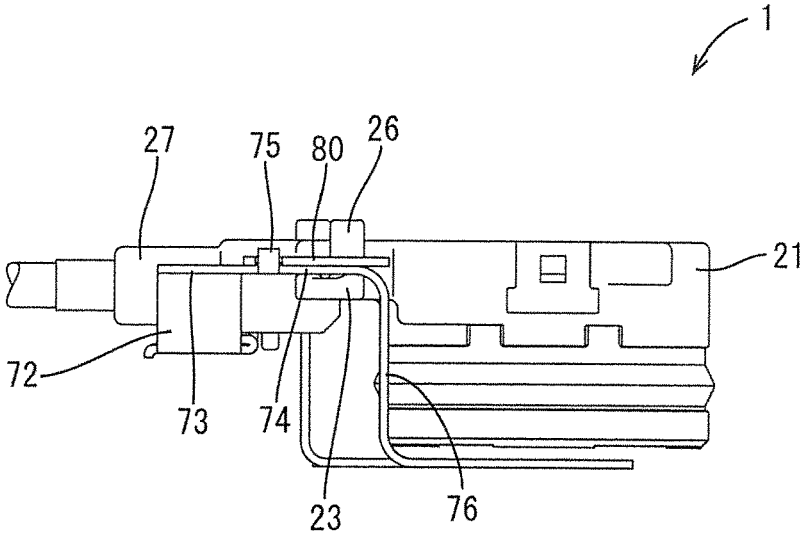
FIG. 8 is a left side view of the shield connector according to the embodiment.
Figure 9:
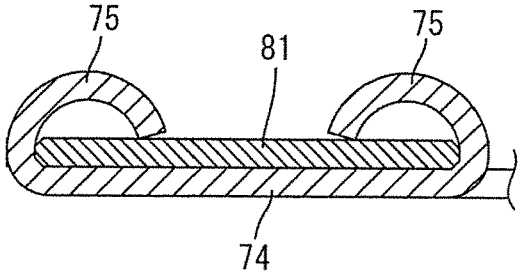
FIG. 9 is a cross-sectional view taken along line A-A in FIG. 3.

As illustrated in FIG. 11, the swaging portion 74 extends from the second horizontal plate portion 73 in a direction perpendicular to the extending direction of the second horizontal plate portion 73 (in a direction toward the outlet body 23 when the shield bracket 40 is fixed to the housing 20, see FIG. 3 and FIG. 8). The two swaging pieces 75 are small planar pieces extending from two parallel side edges of the swaging portion 74 and are bent inwardly as illustrated in FIG. 3 and FIG. 9. FIG. 2 and FIG. 11 illustrate the state of the swaging pieces 75 when the auxiliary bracket 80 is not attached to the main bracket 50 (the swaging pieces 75 are in an upright position relative to the swaging portion 74).

As illustrated in FIG. 2, the second case fixture 76 is a planar portion extending from the swaging portion 74 in a direction perpendicular to the swaging portion 74 and then extending from the extension end in a direction away from the second horizontal plate portion 73. The second case fixture 76 has a bolt insertion hole 77 to which a bolt for fixing the main bracket 50 to the device case is inserted.

The auxiliary bracket 80 is configured to be swaged onto the swaging portion 74 and fixed to the housing 20. As illustrated in FIG. 2, the auxiliary bracket 80 includes an overlapping plate portion 81 (corresponding to a third receiving portion) and an auxiliary attachment piece 82 (corresponding to a second receiving portion).

As illustrated in FIG. 2, the overlapping plate portion 81 is a rectangular planar portion. As illustrated in FIG. 3, FIG. 8, and FIG. 9, the overlapping plate portion 81 is disposed on the swaging portion 74 and is fixed by being sandwiched between the two swaging pieces 75 and the swaging portion 74. As illustrated in FIG. 2, the auxiliary attachment piece 82 is a planar piece extending from the overlapping plate portion 81 and has a second protrusion insertion hole 83 to which the second attachment protrusion 26 is inserted. The second protrusion insertion hole 83 is a through hole extending from one surface of the auxiliary attachment piece 82 to the other surface.

Attachment of Shield Bracket 40 and Shield Conductor 30 to Housing 20

First, in attachment of the shield bracket 40 and the shield conductor 30 to the housing 20, the shield conductor 30 is attached to the main bracket 50. One end portion of the shield conductor 30 is positioned between the first sandwiching portion 52 and the second sandwiching portion 53, and the first sandwiching portion 52 and the second sandwiching portion 53 sandwich the shield conductor 30 therebetween. Thus, the shield conductor 30 is held by the main bracket 50 (see FIG. 10).

Next, the main bracket 50 is attached to the housing 20. The first attachment piece 64 is positioned on the conductor body 23 such that the first attachment protrusion 25 is inserted in the first protrusion insertion hole 65. Then, the main bracket 50 is turned about the first attachment protrusion 25 until the conductor holding portion 51 is positioned along a line of the six outlet tubes 27, and the retaining piece 54 is inserted into the retaining hole 28. In this state, the second connection portion 71 is positioned on the opposite side of the electric wire outlet 22 from the first connection portion 61 (near the attachment portion 24).

Next, the auxiliary bracket 80 is attached to the main bracket 50. The overlapping plate portion 81 is disposed on the swaging portion 74, the auxiliary attachment piece 82 is positioned on the attachment portion 24 such that the second attachment protrusion 26 is inserted in the second protrusion insertion hole 83. Then, the two swaging pieces 75 are bent inwardly such that the overlapping plate portion 81 is sandwiched between the swaging pieces 75 and the swaging portion 74. Thus, the main bracket 50 is fixed to the housing 20 by the auxiliary bracket 80.

Operational Advantages

As described above, in the present embodiment, the shield connector 1 includes the housing 20, the electric wires 11 extending outwardly from the housing 20, the shield conductor 30 shielding the electric wires 11, and the shield bracket 40 holding the shield conductor 30 and attached to the housing 20. The shield bracket 40 includes the main bracket 50 and the auxiliary bracket 80. The main bracket 50 includes the conductor holding portion 51, the first connection portion 61, and the second connection portion 71. The conductor holding portion 51 holds the shield conductor 30 and is positioned along a line of the six outlet tubes 27 of the housing 20. The conductor holding portion 51 and the shield conductor 30 held by the conductor holding portion 51 cover the outlet tubes 27 and the electric wires 11 from one side. Furthermore, the housing 20 includes the first attachment protrusion 25 and the second attachment protrusion 26. The first connection portion 61 includes the first attachment piece 64 in engagement with the first attachment protrusion 25. The auxiliary bracket 80 includes the auxiliary attachment piece 82 in engagement with the second attachment protrusion 26. The second connection portion 71 includes the swaging pieces 75. The overlapping plate portion 81 of the auxiliary bracket 80 is swaged onto the second connection portion 71 by the swaging pieces 75.

For example, the electric wires extending from the shield connector 1 may be bent at a right angle or a sharp angle. In such a case, the shield conductor 30 does not need to be positioned at an inner side of the bent electric wires 11. The electric wires 11 are sufficiently shielded by the shield conductor 30 positioned at an outer side. In this case, employment of the shield connector 1 having the above-described configuration provides a simple structure compared with the conventional configuration including the shield conductors and the brackets arranged in a tubular shape, because one of the two brackets and one of the two shield conductors are eliminated.

In addition, since the shield bracket 40 includes the auxiliary bracket 80, the second connection portion 71 is able to be connected to the housing 20 by using the auxiliary bracket 80 after the first connection portion 61 is attached to the housing 20. This makes the attachment operation easy.

In addition, the first attachment protrusion 25 and the second attachment protrusion 26 are positioned on the opposite side of the housing 20 from the side facing the conductor holding portion 51. In this configuration, the first connection portion 61 and the second connection portion 71 are positioned on the opposite side of the housing 20 from the conductor holding portion 51. This enables the shield bracket 40 to be stably attached to the housing 20.

In this case, the second connection portion and the connector housing may be directly connected to each other without the auxiliary bracket 80. However, such a configuration makes the attachment operation difficult, because, in the attachment operation, the conductor holding portion should be positioned along the connector housing from one side while, on the other side, the first and second connection portions are attached to the respective first and engagement portions. Thus, the attachment operation is difficult. In such a configuration, employment of the auxiliary bracket 80 is particularly effective in making the attachment operation easy. The auxiliary bracket 80 allows the second connection portion 71 to be attached to the housing 20 after the first connection portion 61 is attached to the housing 20.

In addition, the auxiliary bracket 80 includes only the overlapping plate portion 81 and the auxiliary piece 82. This configuration allows the auxiliary bracket 80 to have a minimum size, making the structure of the shield connector 1 simple.

In addition, the conductor holding portion 51 has the retaining piece 54, and the housing 20 has the retaining hole 28 receiving the retaining piece 54. In this configuration, the attachment operation is performed at three positions, i.e., the first attachment protrusion 25 and the first attachment piece 64 are connected to each other, the second attachment protrusion 26, the auxiliary bracket 80, and the second connection portion 71 are connected to each other, and the retaining piece 54 and the retaining hole 28 are connected to each other, and thus the shield bracket 40 is stably attached to the housing 20. However, since the shield bracket 40 is connected to the housing 20 at three positions, the attachment operation may be more complex. In such a configuration, the attachment operation is more effectively made easier by employing the auxiliary bracket 80, which allows the connection at one of the three positions to be separately performed from the connection at the other two positions.

Other Embodiments

The technology disclosed herein is not limited to the embodiment described above and illustrated by the drawings, and the following various aspects will be included, for example.

(1) In the above-described embodiment, the number of the electric wires with terminals held by the connector housing 20 is six, but the number of the electric wires held by the connector housing is not limited to that in the above-described embodiment and may be five or less or seven or more.

(2) In the above-described embodiment, the main bracket 50 has the retaining piece 54 and the connector housing 20 has the retaining hole 28. However, the connector housing may have a fourth receiving portion in a protruded shape and the shield attachment member may have a fourth engagement portion, which is a hole for receiving the fourth receiving portion.

EXPLANATION OF SYMBOLS

1 shield connector
11 electric wire
20 connector housing
25 first attachment protrusion (first engagement portion)

26 second attachment protrusion (second engagement portion)
28 retaining hole (fourth engagement portion)
30 shield conductor
40 shield bracket (shield attachment member)
50 main bracket (main attachment member)
51 conductor holding portion
54 retaining piece (fourth engagement portion)
61 first connection portion
64 first attachment piece (first receiving portion)
75 swaging piece (third engagement portion)
71 second connection portion
80 auxiliary bracket (auxiliary attachment member)
81 overlapping plate portion (third receiving portion)
82 auxiliary attachment piece (second receiving portion)

The invention claimed is:

1. A shield connector comprising:
a connector housing;
an electric wire extending outward from the connector housing;
a shield conductor shielding the electric wire, and
a shield attachment member holding the shield conductor and attached to the connector housing, wherein
the shield attachment member includes a main attachment member and an auxiliary attachment member attached to the main attachment member,
the main attachment member includes a conductor holding portion positioned on one side of the connector housing and a first connection portion and a second connection portion each extending from the conductor holding portion,
the shield conductor held by the conductor holding portion covers the electric wire from the one side,
the connector housing includes a first engagement portion and a second engagement portion, the first connection portion includes a first receiving portion in engagement with the first engagement portion, and the auxiliary attachment member includes a second receiving portion in engagement with the second engagement portion,
the second connection portion includes a third engagement portion, and the auxiliary attachment member includes a third receiving portion in engagement with the third engagement portion, and
the auxiliary attachment member includes only the second receiving portion and the third receiving portion.

2. The shield connector according to claim 1, wherein the first engagement portion and the second engagement portion are positioned on an opposite side of the connector housing from a side facing the conductor holding portion.

3. The shield connector according to claim 1, wherein one of the connector housing and the conductor holding portion includes a fourth engagement portion and the other includes a fourth receiving portion in engagement with the fourth engagement portion.

4. A shield connector, comprising:
a connector housing (20) having opposite first and second sides and first and second longitudinal ends (21C, 21D), and first and second engagement portions (25, 26) formed in proximity to the first and second longitudinal ends (21C, 21D);
an electric wire (11) extending outward from the connector housing (20);
a shield attachment member (40) attached to the connector housing (20) and comprising:
a main attachment member (50) having a conductor holding portion (51) positioned on the first side of the connector housing and holding a shield conductor (30) shielding the electric wire (11), and first and second connection portions (61, 71) extending from the conductor holding portion (51) to positions in proximity to the first and second longitudinal ends (21C, 21D) of the connector housing (20), the first connection portion (61) having a first receiving portion (64) engaged directly with the first engagement portion (25) of the connector housing (20); and
an auxiliary attachment member (80) formed separately from the main attachment member (50) and attached to the second connection portion (71) of the main attachment member (50), and the auxiliary attachment member (80) including a second receiving portion (82) attached to the second engagement portion (26) of the connector housing (20).

5. The shield connector according to claim 4, wherein the auxiliary attachment member includes only the second receiving portion and the third receiving portion.

6. The shield connector according to claim 5, wherein one of the connector housing and the conductor holding portion includes a fourth engagement portion and the other includes a fourth receiving portion in engagement with the fourth engagement portion.

7. The shield connector of claim 4, wherein the auxiliary attachment member (80) includes an overlapping plate portion (81) in contact with the second connection portion (71), and the second receiving portion (82) is a through hole extending through the overlapping plate portion (81).

8. The shield connector of claim 4, wherein the second connection portion (71) includes a swaging portion (75) and the auxiliary attachment member (80) is swaged to the second connection portion (71).

9. A shield connector comprising:
a connector housing;
an electric wire extending outward from the connector housing;
a shield conductor shielding the electric wire, and
a shield attachment member holding the shield conductor and attached to the connector housing, wherein
the shield attachment member includes a main attachment member and an auxiliary attachment member attached to the main attachment member,
the main attachment member includes a conductor holding portion positioned on one side of the connector housing and a first connection portion and a second connection portion each extending from the conductor holding portion,
the shield conductor held by the conductor holding portion covers the electric wire from the one side,
the connector housing includes a first engagement portion and a second engagement portion, the first connection portion includes a first receiving portion in engagement with the first engagement portion, and the auxiliary attachment member includes a second receiving portion in engagement with the second engagement portion,
the second connection portion includes a third engagement portion, and the auxiliary attachment member includes a third receiving portion in engagement with the third engagement portion,
the first engagement portion and the second engagement portion are positioned on an opposite side of the connector housing from a side facing the conductor holding portion, and
one of the connector housing and the conductor holding portion includes a fourth engagement portion and the other includes a fourth receiving portion in engagement with the fourth engagement portion.

* * * * *